US005702258A

United States Patent [19]

Provencher et al.

[11] Patent Number: 5,702,258

[45] Date of Patent: Dec. 30, 1997

[54] ELECTRICAL CONNECTOR ASSEMBLED FROM WAFERS

[75] Inventors: Daniel B. Provencher, Weare, N.H.; Philip T. Stokoe, Attleboro; Mark W. Gailus, Somerville, both of Mass.

[73] Assignee: Teradyne, Inc., Boston, Mass.

[21] Appl. No.: 623,582

[22] Filed: Mar. 28, 1996

[51] Int. Cl.[6] ..... H01R 9/09

[52] U.S. Cl. ..... 439/79; 439/608

[58] Field of Search ..... 439/79, 108, 608, 439/607, 620

[56] References Cited

U.S. PATENT DOCUMENTS

| | | | |
|---|---|---|---|
| 4,464,003 | 8/1984 | Goodman | 439/404 |
| 4,596,428 | 6/1986 | Tengler | 439/95 |
| 4,655,515 | 4/1987 | Hamsher, Jr. | 439/108 |
| 4,705,332 | 11/1987 | Sadigh-Behzadi | 439/69 |
| 4,824,383 | 4/1989 | Lemke | 439/108 |
| 4,846,727 | 7/1989 | Glover | 439/608 |
| 4,882,554 | 11/1989 | Akaba | 333/105 |
| 4,975,084 | 12/1990 | Fedder | 439/608 |
| 5,066,236 | 11/1991 | Broeksteeg | 439/79 |
| 5,117,331 | 5/1992 | Gebara | 361/175 |
| 5,228,864 | 7/1993 | Fusselman et al. | 439/607 |
| 5,496,183 | 3/1996 | Soes | 439/79 |
| 5,580,283 | 12/1996 | O'Sullivan et al. | 439/607 |

FOREIGN PATENT DOCUMENTS

| | | |
|---|---|---|
| 0 212 764 A2 | 3/1987 | European Pat. Off. . |
| 0 422 785 A2 | 4/1991 | European Pat. Off. . |
| WO 88/05218 | 7/1988 | WIPO . |

*Primary Examiner*—Neil Abrams
*Assistant Examiner*—T. C. Patel
*Attorney, Agent, or Firm*—Edmund J. Walsh

[57] ABSTRACT

A modular electrical connector made from wafers. Each wafer contains one column of contact elements and is made separately. The wafers are of two different types, which snap together to form two row modules. The modules contain attachment features that allow them to be organized on a metal stiffener. Shield members can be optionally attached to each wafer so that the connector can be made in either a shielded or unshielded versions. In addition, each wafer includes windows through which selected contact elements can be cut to either improve the performance of the shields or to allow attachment of resistors.

21 Claims, 5 Drawing Sheets

ELECTRICAL CONNECTOR ASSEMBLED FROM WAFERS

This invention relates generally to electrical connectors and more specifically to electrical connectors assembled from wafers.

Electrical connectors are used in many types of electronic systems. For example, in many computerized systems, printed circuit boards are joined together through connectors. One piece of the connector is attached to each board. The connector pieces are mated to complete many signal paths between the boards. In addition, the DC power or ground paths are also completed through the connector. The DC paths allow the printed circuit boards to be powered and, if configured appropriately, shield adjacent signal contacts to improve the integrity of signals passing through the connector.

Each half of the connector contains conducting contacts held in an insulative housing. Each contact has a contact region, which makes electrical contact to a contact in the other half of the connector when the connectors are mated. In addition, each contact has a tail portion which extends from the housing and is attached to a printed circuit board. The tail could be either a solder tail, which is soldered to the printed circuit board, or a press-fit tail, which is held by friction in a hole in a printed circuit board. The contact body carries the signal from the contact region to the tail.

One common type of signal contact simply uses a pin as the contact region. Pin contacts generally mate with receptacle type contacts. The contact area of a receptacle type contact is formed from a pair of opposing cantilevered beams. The pin is inserted between the beams. The cantilevered beams generate a spring force against the pin, ensuring a good electrical contact.

Other types of contacts are also used. For example, contacts shaped as plates, blades or forks have all been used.

Connector housings are often molded from plastic. Initially, connector housings were molded in one piece. However, it was difficult to maintain the necessary tolerances for large connectors and it was discovered that building large connectors from individual modules was easier. The modules were held together and positioned using a metal stiffener. A long metal stiffener can be made with greater accuracy than a similar sized housing can be molded. U.S. Pat. Nos. 4,655,518 and 5,403,206 are examples of modular connectors using stiffeners.

U.S. Pat. No. 5,066,236 gives an alternative approach to manufacturing connectors. That patent shows a connector in which each column of contacts is molded in a separate subassembly. The subassemblies are then inserted into housing modules, which are aligned to form a long connector.

The above mentioned U.S. Pat. Nos. 5,403,206 and 5,066,236 each show embodiments in which the receptacle portion of the connector has shield elements between each column. Shielding between columns of signal contacts is also shown in U.S. Pat. Nos. 4,975,084 and 4,846,727.

Commercial embodiments of the connectors described in the above mentioned patents have adjacent columns of signal contacts spaced by 2 mm or more. It is desirable for many applications to have connectors with a high signal density. The signal density of a connector indicates the number of contacts that can carry signals per unit length of the connector.

However, it is often not possible to increase the signal density of a connector simply by positioning the contacts closer together. As the contacts are placed closer together, there is more electrical interaction between the signals on those contacts. This interaction causes signal distortion or noise, which is very undesirable. To counter these problems, it is then necessary to use some of the signal contacts to carry ground signals. The net effect is often no increase in the signal density of the connector. It would be highly desirable to have a simple way to manufacture connectors with closely spaced contacts.

Connectors according to the invention also solve another important problem. Bus traces on backplane assemblies often have a small resistor connected to them in order to provide the required electrical characteristics. In some instances, via holes are made through the printed circuit board forming the backplane and the resistors make contact with the traces through the via holes. This approach has the drawback of sometimes requiring the backplane assembly to be larger in order to accommodate the resistors. In addition, the via holes sometimes act as stubs on a transmission, which distorts the signals on the bus traces.

An alternative approach to connecting resistors is to use what is sometimes called buried layer technology. With this approach, the resistors are buried inside the printed circuit board. However, each buried layer can add significant cost to the assembly and is therefore undesirable. It would be highly desirable to be able to use many resistors on a backplane assembly without a large increase in cost and without requiring additional space for the resistors.

SUMMARY OF THE INVENTION

With the foregoing background in mind, it is an object of the invention to provide a simple method of manufacturing electrical connectors.

It is another object of the invention to provide a connector in which adjacent columns of contacts are spaced very close together.

It is also an object to provide a low cost method of manufacturing a shielded connector made with pins.

It is a further object to provide a connector made from subassemblies having improved shielding.

It is yet another object to provide a simple way to provide resistive loads on a printed circuit board.

The foregoing and other objects are achieved by forming wafers, each having insulating material around one row of contact elements. The wafers are connected to a metal stiffener.

In one embodiment, multiple wafers are connected together into small modules, which are then attached to a stiffener, In an alternative embodiment, shield pieces are connected to the wafers before they are assembled into a connector. The shield pieces are connected to the contact end and tail end of a contact element in the wafer. In one embodiment, there is a break between the contact end and the tail end of the connector element to which the shield is attached. This configuration requires that current flow through the shield piece, thereby increasing its effectiveness.

In a preferred embodiment, the portions of the contact elements molded inside a wafer are exposed through a window in the wafer. The break in the contact element connected to the shield is formed by cutting the contact element through the window.

In one embodiment, resistors are placed in the windows in the wafer, joining exposed ends of the contact. The resistors provide a desired resistance in a signal path, which might be useful in a backplane application.

BRIEF DESCRIPTION OF THE DRAWINGS

The invention will be better understood by reference to the following more detailed description and accompanying drawings in which.

DESCRIPTION OF THE PREFERRED EMBODIMENT

Figure 1:
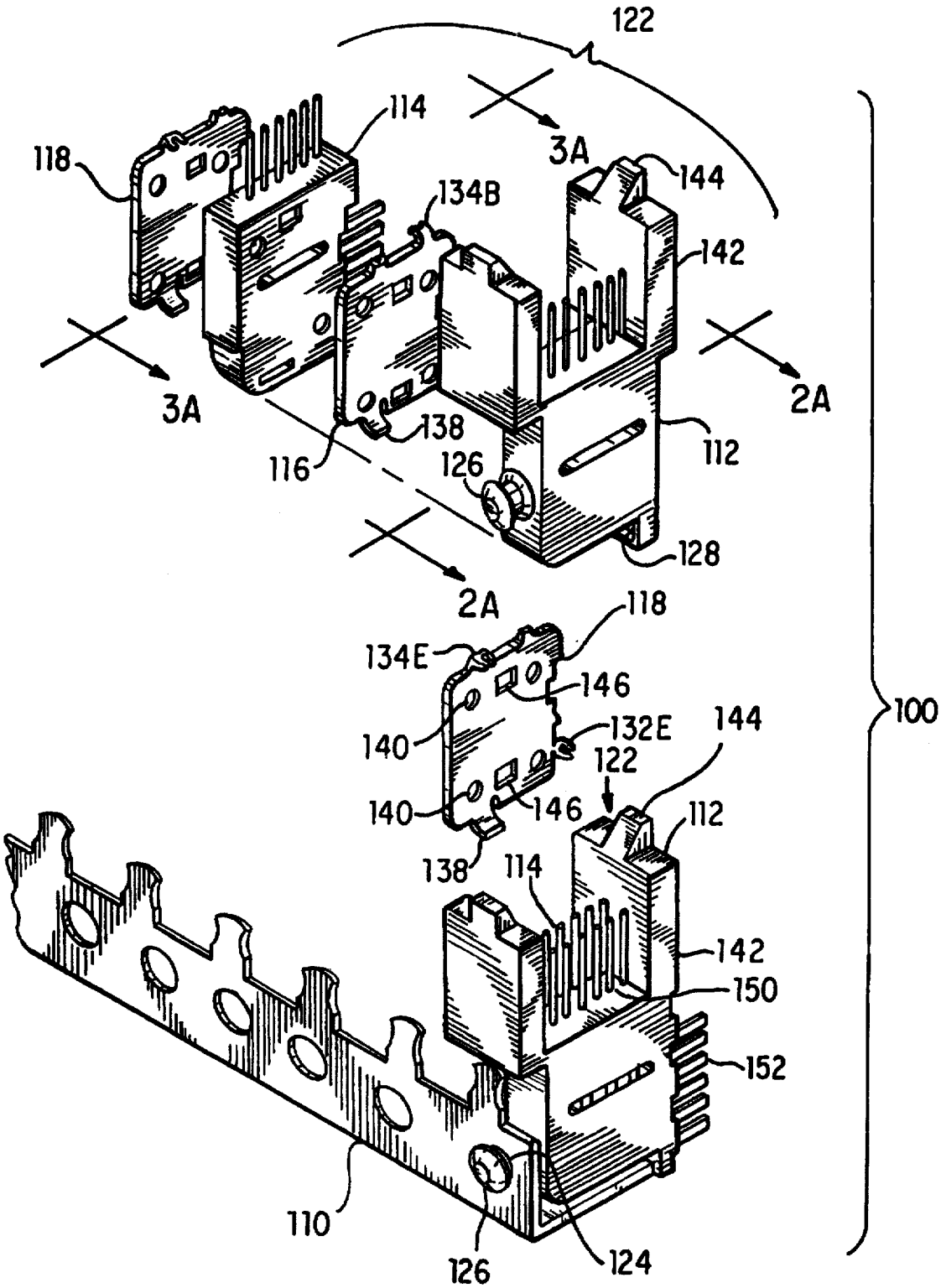
FIG. 1 is an exploded view of a connector manufactured according to the invention.

FIG. 1 shows a connector 100 built up from wafers 112 and 114. Each wafer 112 and 114 contains one column of contact elements (410A . . . 410F, FIG. 4A). In the embodiment shown, the connector elements have contact regions in the form of pins 150 and press fit solder tails 152. In a preferred embodiment, the pins 150 and solder tails 152 extend from the wafers 112 and 114 at right angles. Connector 100 is therefore a "right angle" connector.

Wafers 112 and 114 are connected together to form a module 122. Modules 122 are attached to stiffener 110.

Stiffener 110 is a metal stiffener as is conventionally used in the art. It is stamped from a piece of metal, such as stainless sheet steel and then bent at a right angle as shown in FIG. 1. Stiffener 110 includes holes 124 and barbs (not shown) for attachment of modules 122. Stiffener 110 is as shown in pending U.S. patent application by Provencher et al., titled "Stiffner For Electrical Connector" and filed Dec. 21, 1995, which is hereby incorporated by reference.

Wafers 112 have a hub 126 on a front surface (not numbered) and a slot 128 formed in a projection 130 extending from a lower surface (not numbered). Hub 126 is inserted into a hole 124 and slot 128 receives a barb. Wafer 112 is therefore secured to stiffener 110 as described in the above mentioned U.S. patent application to Provencher et al.

Because wafer 114 is secured to wafer 112, the entire module 122 is secured to stiffener 110. Stiffener 110 has a repeating pattern of holes and barbs. Therefore, any number of modules 122 can be secured side by side along stiffener 110 to form a connector with as many columns of contacts as desired. In use, material to form stiffener 110 would be formed in long rolls and then cut to the desired length to make a connector.

FIG. 1 shows that wafers 112 and 114 are separated by shields 116 and 118. Shields 116 attach to the side of wafers 112 and shields 118 attach to the side of the wafers 114. Each of the shields 116 and 118 attaches to one of the contact elements 410 (FIG. 4) in a module. Each shield 116 and 118 makes electrical connection at two points to a contact element 410 and, as will be described below, there is a break in the contact element 410 between these two points.

Shield 118 has contact tabs 132E and 134E. Contact tab 132E fits into recess 312 (FIG. 3A) in wafer 114 and engages the contact element near tail portion 136. Contact tab 134E engages the same contact element near pin 120. Each contact tab 132E and 134E has pincer members integrally formed therewith to make electrical contact to the contact member.

Shield 118 contains four holes 140. Holes 140 engage alignment hubs 314 on wafer 114, thereby positioning the shield. Locking tab 138 on shield 118 fits into slot 318 (FIG. 3A) on wafer 114, thereby securing the shield 118 to wafer 114.

Shield 118 additionally includes 2 holes 146. Holes 146 are sized and positioned to allow latches 222 (FIG. 2B) on wafers 112 to project through them.

Shield 116 has similar features to engage a contact element on wafer 112 and to be secured to wafer 112. Locking tab 138 on shield 116 fits into slot 218 (FIG. 2A) on wafer 112, thereby securing the shield 116 to wafer 112. Shield 116 differs from shield 118 in that it lacks contact tabs 132E an 134E, but has instead contact tabs 132B and 134B. Contact tabs 132B and 134B are shaped the same as tabs 132E and 134E. However, they are positioned to engage a contact element in a different row of the connector 100.

The rows of contacts in a connector are often designated with letters starting at A. Connector 100 is shown to have six rows of contacts. The rows are designated A through F. Contact tabs 132B and 134B on shield 116 engage a contact in the B-row. Contact tabs 132E and 134E on shield 116 engage a contact in the E-row. In order that these shields be grounded, it is necessary to have "an alternative row ground pattern" on the circuit board (not shown) to which connector 100 is attached. In other words, the tails 136 of the B-row contact members in wafers 112 are connected to ground traces on the printed circuit board (not shown). The tails 136 of the E-row contact members in wafers 114 are connected to ground traces.

In this way, at least one contact in each column of contacts is connected to ground. The specific contact connected to ground alternates in adjacent columns between the B-row and the E-row. Shielding between each column is thereby achieved. Use of shield members 116 and 188 is, however, optional. Connector 100 may be assembled either as a shielded or un-shielded connector.

In a preferred embodiment, shields 116 and 118 are stamped from metal sheets. In the stamping operation, shield blanks containing contact tabs 132B, 132E, 134B and 134E are first made. To make shields 116, contact tabs 132E and 134E are cut off. To make shields 118, contact tabs 132B and 134B are cut off. Then the remaining contact tabs 132 and 134 and locking tab 138 are bent at approximately a right angle.

As shown in FIG. 1, wafers 112 include shrouds 142. The shrouds 142 extend the width of both columns of contacts in a module 122. As multiple modules 122 are attached to stiffener 110, the shrouds 142 will extend the length of the connector 100. Shrouds 142 form the sidewalls of the connector 100.

Figure 2A:
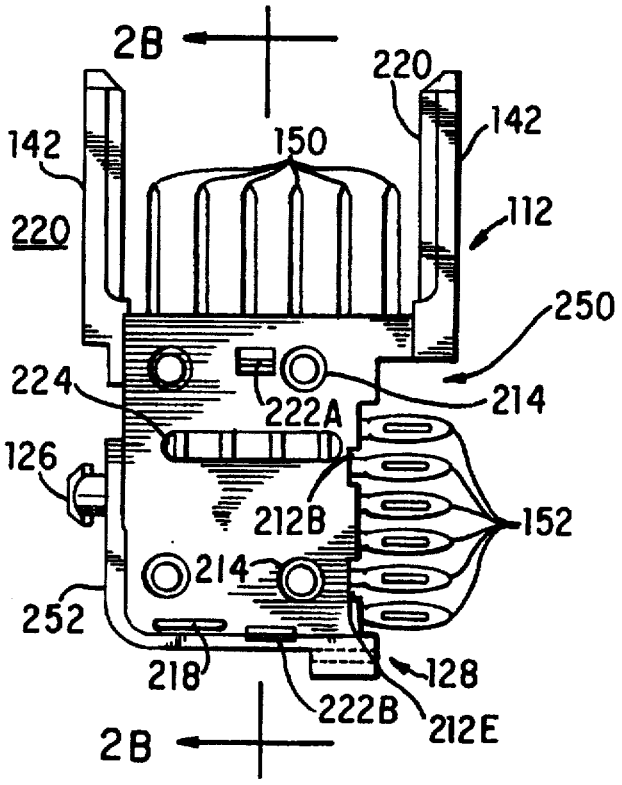
FIG. 2A shows a side view of a wafer taken through the line 2A—2A in FIG. 1.
Figure 2B:
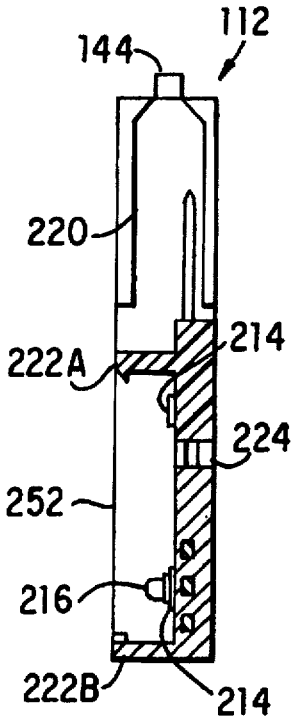
FIG. 2B shows a cross section of the wafer of FIG. 2A taken along the line 2B—2B.

Shrouds 142 contain any features which might typically be found in the sidewalls of a connector. For example, shrouds 142 are molded with projections 144. They might also be formed with alignment ribs 220 (FIGS. 2A and 2B). These features aid in the insertion of a mating connector between the sidewalls of connector 100.

Turning now to FIGS. 2A and 2B, additional details of a module 112 are shown. Four alignment hubs 214 for positioning shield 116 are shown. Locking hubs 216 extend from two of the four alignment hubs 214. Locking hubs 216 engage holes 450 (FIG. 4B) in wafer 114 to aid in forming a snap fit connection when wafers 112 and 114 are pressed together.

Figure 3A:
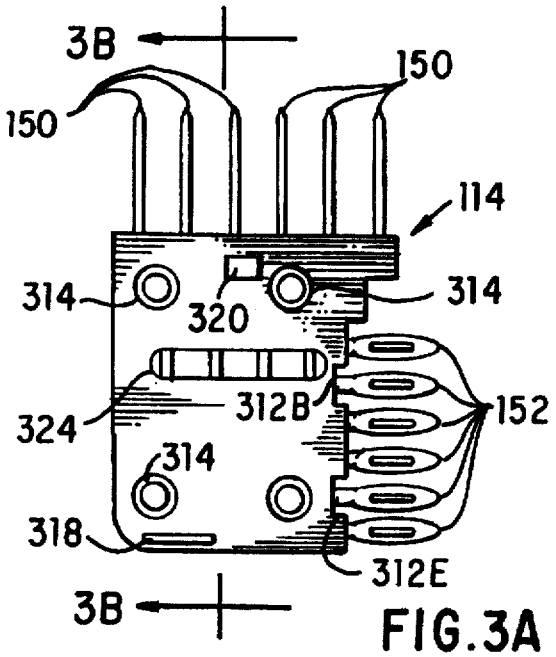
FIG. 3A shows a side view of a wafer taken through the line 3A—3A in FIG. 1.

Latches 222A and 222B also aid in forming the snap fit connection between modules 114 and 112. Latch 222A fits into catch 320 (FIG. 3A). Latch 222B fits under module 114. As shown, each latch 222A and 222B are elongated and therefore slightly flexible. The end surface (not numbered) of each latch is tapered so that the latch 222A or 222B will ride up as it encounters a catch feature on wafer 114. As modules 112 and 114 are pushed together, the tapered surface (not numbered) will clear the catch feature, causing latch 222A and 222B to return to its undeformed position while engaging the catch feature. Such snap fit elements are well known in the art.

Module 112 includes a wall 252 around two edges of the module. Wafer 114 rests against this wall when wafers 112 and 114 are snapped together. Wall 252 provides a point of attachment for hub 126 which is in the center of the module 122 (FIG. 1).

Figure 3B:
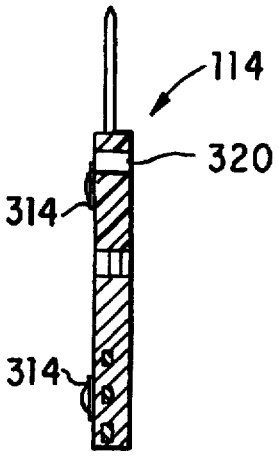
FIG. 3B shows a cross section of the wafer of FIG. 3A taken along the line 3B—3B.

FIGS. 3A and 3B show similar views of module 114.

Figure 4A:
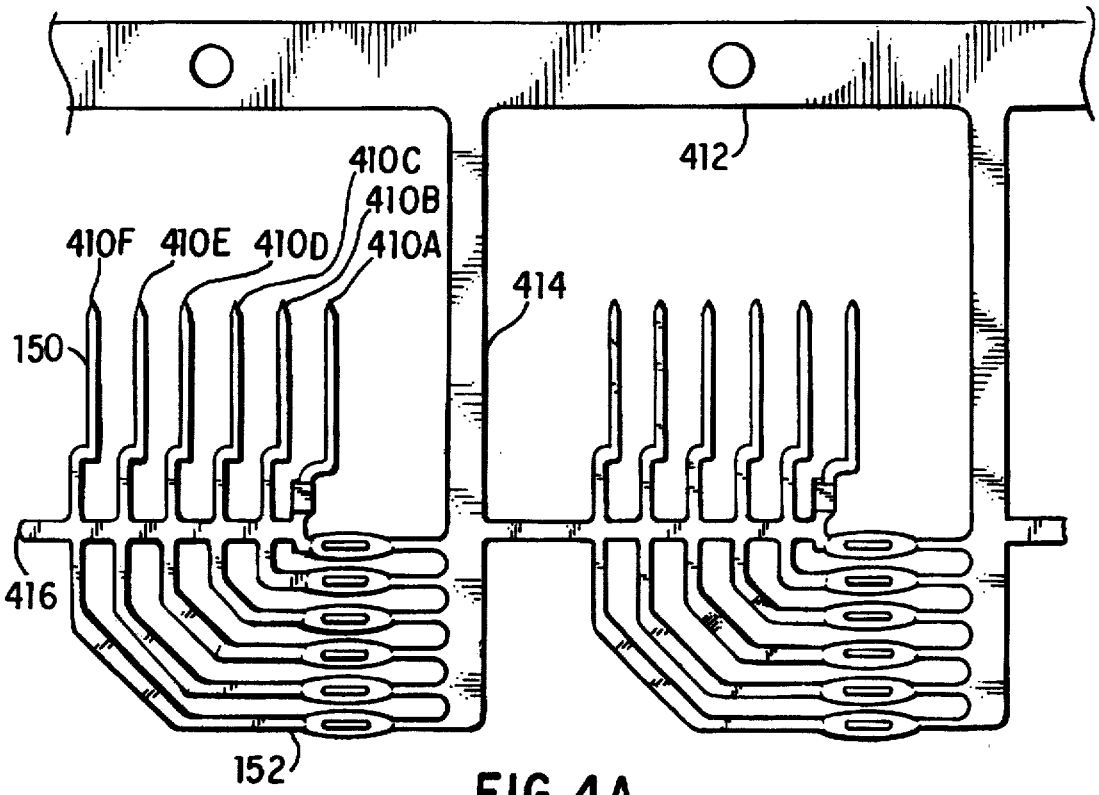
FIG. 4A illustrates blanks used to make wafers.

Turning now to FIG. 4A, details of the manufacturing process are shown. To manufacture wafers 112 and 114, groups of contacts 410A . . . 410F are stumped from a metal sheet. The contacts are stamped to leave carrier strips 412, 414 and 416. The carrier strips serve to hold the contacts 410A . . . 410F together and to facilitate handling the contacts.

If necessary, the pin portions 150 are coined and rotated 90°. In use, the pin portion 150 is likely to engage a receptacle type contact made up of two cantilevered beams. It is desirable for the cantilevered beams to slide along the coined surface of the pin portion 150. If necessary to ensure the proper orientation between the beams and the pins, the beams can be rotated.

An insulative housing is injection molded around the contacts 410A . . . 410F. Prior to the molding step, carrier strip 416 is cut to separate the individual contacts 410A . . . 410F.

Figure 4B:
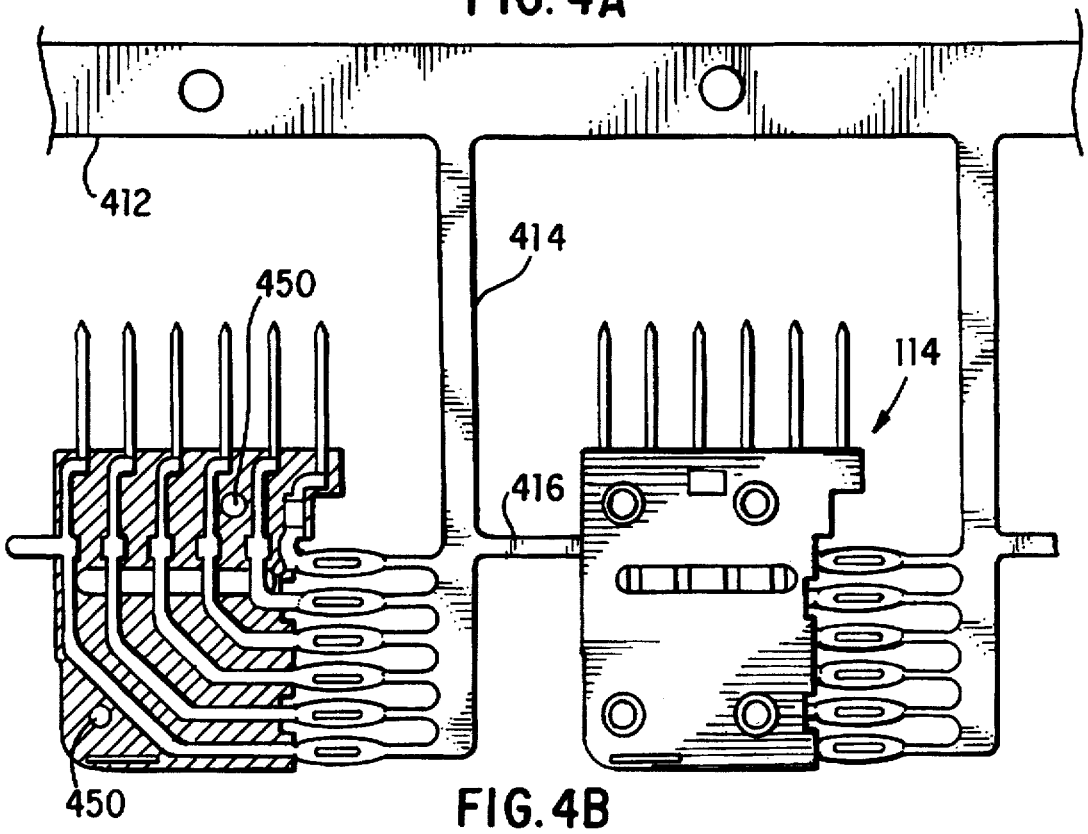
FIG. 4B illustrates the molding around the blank of FIG. 4A used to form a wafer as illustrated in FIG. 3.

FIG. 4B shows insulative housings shaped like wafer 114 molded around the contacts. The molding operation is performed while contacts 410A . . . 410F are still connected to carrier strips 412, 414 and 416. After the molding operation is complete, the carrier strips are cut away to leave wafers of the required form. The carrier strips are cut away at any convenient time when they are no longer needed for ease of handling the wafers.

Figure 4C:
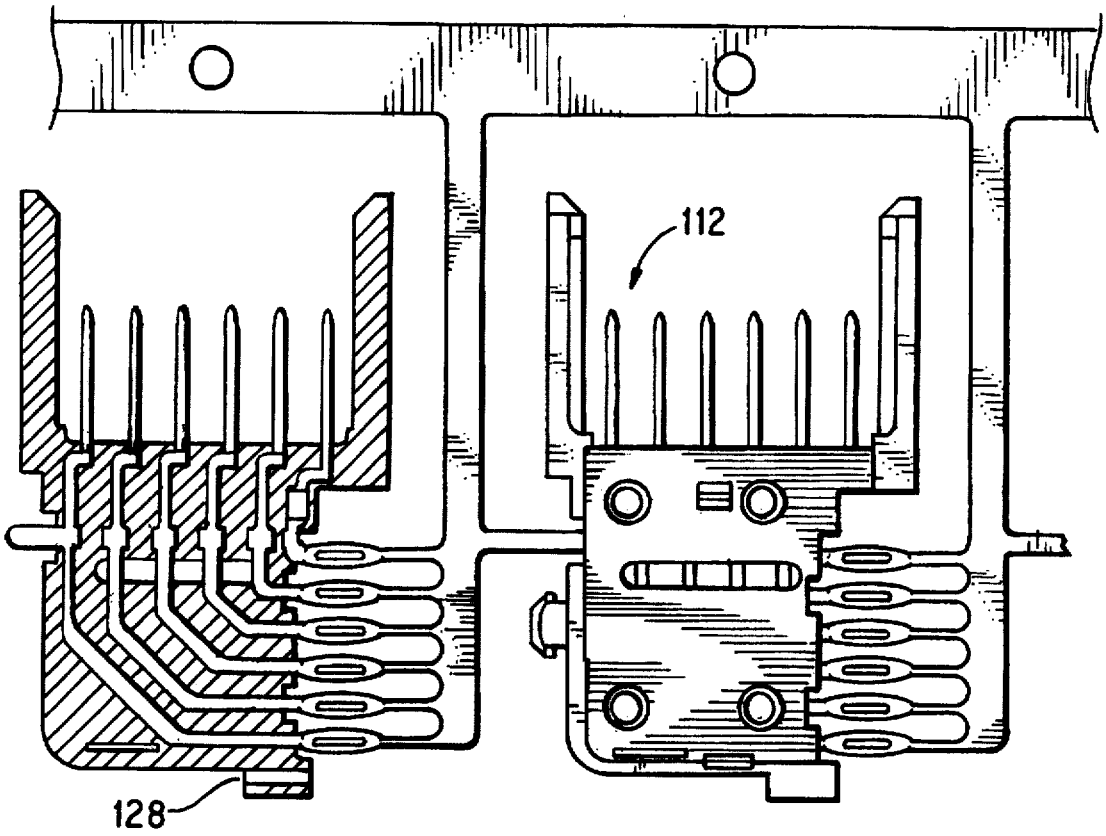
FIG. 4C illustrates the molding around the blank of FIG. 4A used to form a wafer as illustrated in FIG. 2.

FIG. 4C shows a similar molding operation for wafers 112. The same contacts 410A . . . 410F can be used to make wither wafers 112 or 114. The only difference is in the housing molded around the contacts. The features of wafers 112 and 114 can in general be made using simple two sided molds. Slot 128 can not be formed with such a mold and a mold with a piston or similar element is needed to form slot 128. Such molding is well known in the art.

As described above, improved electrical properties are obtained if the contacts to which the shields 116 and 118 are electrically connected are severed. Windows 224 and 324 are included for this purpose. In the embodiment shown, windows 224 and 324 expose contacts 410B . . . 410E, any of which might be easily cut. For wafers 112, contact 410B is cut. For wafers 114, contact 410E is cut.

Figure 5:
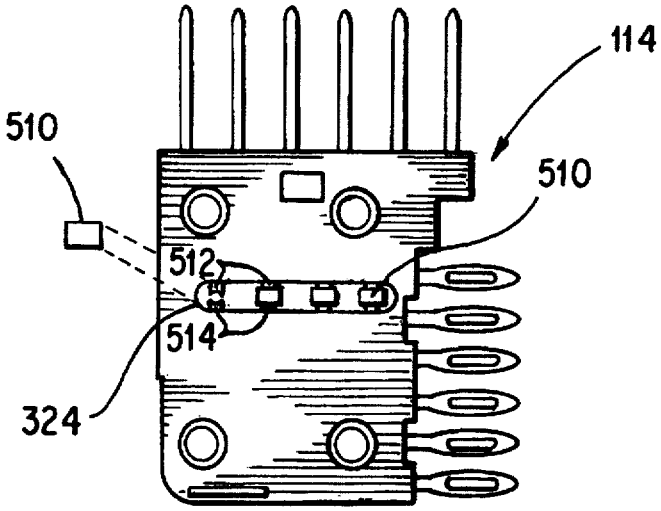
FIG. 5 illustrates a connector according to the invention incorporating resistive loads.

Turning now to FIG. 5, an alternative use of windows 224 and 324 is shown. All of the exposed contacts 410B . . . 410F might be cut, leaving exposed ends 512 and 514. Circuit elements could then be connected to exposed ends 512 and 514. FIG. 5 shows that resistors 510 are connected to the exposed ends. Resistors 510 are relatively small valued resistors, such as between 1Ω and 250Ω. More preferably, the resistors are in the range of 5Ω to 100Ω. Resistors in this could replace resistors in the backplane assembly (not shown) to which connector 100 is mated or a circuit board (not shown) to which connector 100 is attached.

Resistors 510 are attached to the exposed contacts using conventional surface mount manufacturing techniques.

In use, connector 100 is likely attached to a printed circuit board (not shown). Notch 250 is designed to receive the edge of a printed circuit board. Connector 100 would therefore be used as an edge mounted connector. It might be used to mate the printed circuit board to a backplane assembly. Connector 100 might also be used to mate the printed circuit board to another printed circuit board in an application commonly called a mezzanine card or an extender card.

In the shielded configuration, the shields should be connected to an AC ground. Thus, those contacts connected to the shields are connected to a ground trace on the printed circuit board to which connector 100 is mounted.

The dimensions of the various elements of the connector are not critical. However, an important advantage of connector 100 is that the contacts 410A . . . 410F in each row can be positioned very close together. In addition, the adjacent rows can be placed very close together. In a preferred embodiment, the pins 150 in wafers 112 are less than 2 mm on center from the pins 150 in wafers 114. Preferably, the spacing is 1.5 mm. Likewise, the spacing between adjacent pins 410A . . . 410F in each module is 2 mm or less. The spacing could also be 1.5 mm in this direction as well. These dimensions are particularly significant in light of the fact that the connector can be made in a shielded configuration.

In a preferred embodiment, the thickness of each wafer 112 and 114 is approximately 1.35 mm. Each shield is approximately 0.15 mm. To make a connector with 1.5 mm spacing between adjacent columns of contacts, hubs 214 and 314 have a height of approximately 0.15 mm. To make a connector with a 2 mm spacing between adjacent columns of contacts, hubs 214 and 314 have a height of approximately 0.65 mm to increase the spacing between the rows of contacts. Thus, by changing the dimension of just these pieces, the spacing between columns can be conveniently altered.

Having described one embodiment, numerous alternative embodiments or variations might be made. For example, each wafer 112 and 114 is shown with a single window 224 and 324, respectively. Individual windows might be molded over each contact 410A . . . 410F, or only those that need to be cut. If individual windows are used, each window could be smaller. The windows might be circular or could be shaped to receive individual resistors 510. If individual windows are used, they might be positioned diagonally across the wafer to improve the mechanical integrity of the wafer.

As another example, it is not necessary that contacts be severed through a window after the insulative housing is molded around the contacts. If a contact is severed before molding, the window might be eliminated entirely. Further, it is not necessary to sever the contacts at all. If the connector is used in an un-shielded version without resistors such as 510, there is no reason to sever any contacts. It is also possible to use the shields without severing the contact; though reduced shielding results in this configuration.

Additionally, it has been shown that each shield 116 and 118 is connected to only one contact. It might be desirable in some circumstances to connect each shield to two or more contacts. Improved shielding would result in this configuration, but fewer contacts would be available to carry signals.

An alternative row ground pattern was illustrated as the preferred embodiment, with ground contacts alternating between the B-row and E-row in adjacent columns. It is possible that the ground pattern might be programmed to optimize for different types of signals. Different ground patterns might be used for single ended signals, differential signals or bus structures. A connector manufactured according to the invention can be used with any ground pattern. Different ground patterns are simply achieved by varying the number and positioning of the connections between the shields and the contact elements. Because each column of contacts is formed as a separate wafer, it would be easy to form in advance wafers with different ground configurations. Upon assembly of the connector, the wafers with the desired grounding configuration would be selected.

Also, it should be appreciated that various features have been shown to snap wafers 112 and 114 together. Many alternative means of attachment might be used. Moreover, it is not strictly necessary that wafers 112 and 114 be snapped together to form a module before assembly on a stiffener 110. One advantage of first assembling modules is that it ensures that the correct alternating pattern of shields 116 and 118 is achieved. Each module includes one shield 116 and one shield 118. Thus, when the modules are placed side to side, the correct pattern results.

A second advantage of first assembling wafers into modules is that it allows stiffeners compatible with prior art products to be used. However, in applications in which these advantages are not important, it is not necessary to first connect wafers together into modules. Individual wafers might be assembled directly to stiffener 110. In that case, all the wafers might be identical, with each including a hub 126 and a slot 128.

Also, it should be noted that the presently preferred embodiment has holes 124 and barbs as attachment features. Any attachment features might be used. For example, the position of the holes and barbs might be reversed. Alternatively, a second barb might be used in place of a hole. The second barb might, for example, be formed by bending a tab on the stiffener so that it is parallel with the first barb.

Also, it should be noted that the drawings show that pairs of wafers 112 and 114 are snap fit together. This arrangement makes a rigid module. No engagement between adjacent modules is shown. However, it will be appreciated that a more rigid connector could be made if there were some means of engagement between adjacent modules. Any convenient form of engagement might be used. If the engagement between modules were rigid and durable enough, embodiments might be constructed without a stiffener.

Figures 6A, 6B:
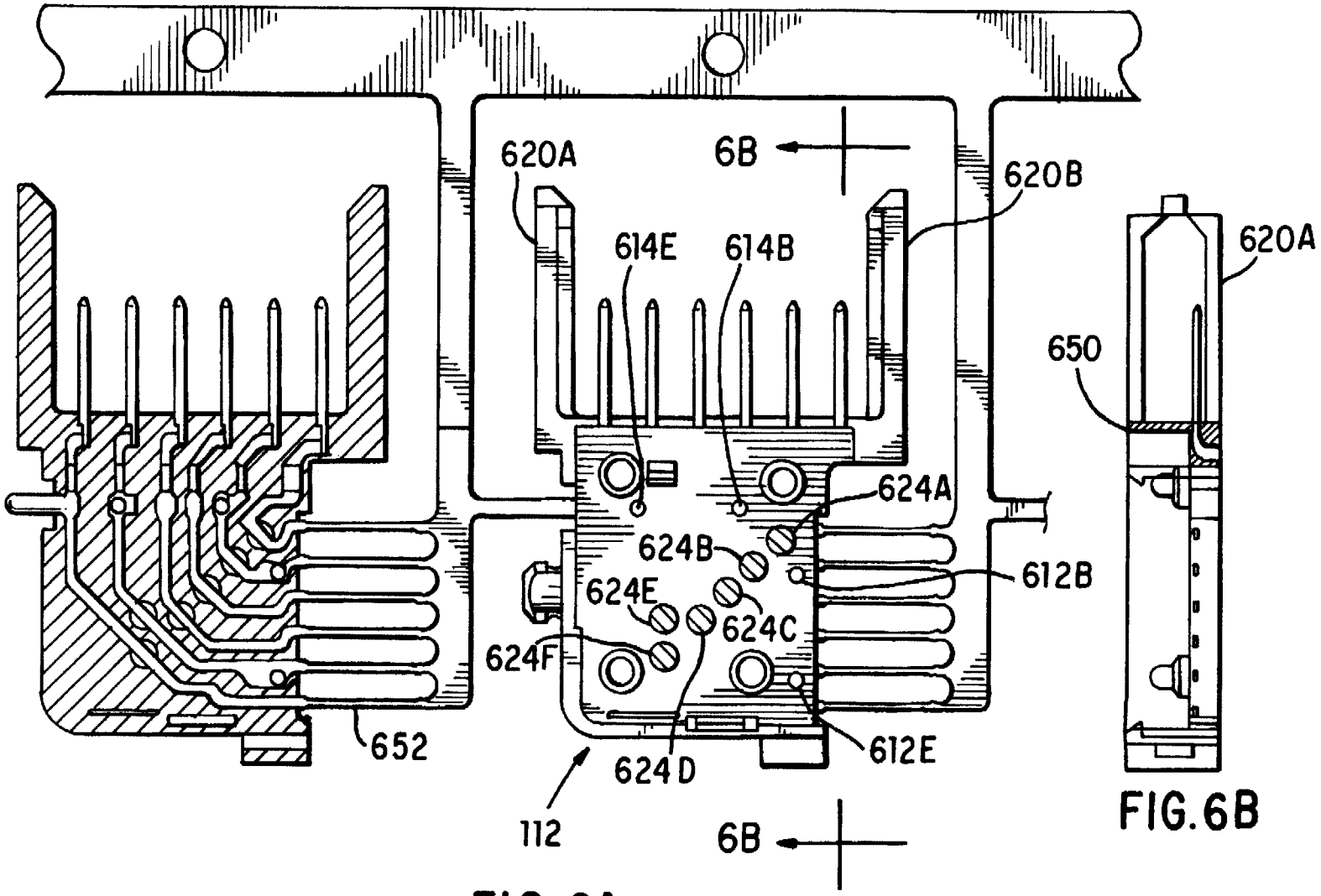
FIG. 6A is a view, partially cut away, of an alternative embodiment of the invention.
FIG. 6B is a view of the connector of FIG. 6A through line 6B—6B.

FIG. 6A and 6B show an alternative construction of a wafer 112. The contact tails 652 in FIG. 6A are solder type tails rather than press fit tails. In addition, the method of attachment of shields is different than for shields 118. FIG. 6A shows that the B-row and E-row contacts each have a pair of holes 612B and 614B and 612E and 614E. Shields are connected to these contacts by inserting a feature from the shiled into the holes. For example, a feature with a barb-like end might be used. Alternatively, a feature with a pincer type end might be inserted into the hole and held in place through friction.

A further difference in the wafer of FIG. 6A is the use of a plurality of separate windows 624A . . . 624E in place of window 224 or 324. The separate windows allow all of the contacts to be exposed. They also facilitate positioning of resistors such as 510.

One further variation can also be observed in FIG. 6B. Web 650 joins shrouds 620A and 620B. Web 650 reinforces the wafer at its weakest point, which is at the base of shroud 620B. Though not shown explicitly in FIG. 6B, web 650 contains notches in it to receive the pins 150 ffrom wafer 114.

Further variations on the positioning of the resistors 510 could also be made. One useful variation would be to make the resistors more accessible in the assembled connector in the event they needed to be changed or replaced. For example, the wafers 112 or 114 might be made in two pieces. One piece would be an insert containing pins 150. The insert would contain the resistors 510. The insert would snap fit into the module, allowing access to the resistors for repair or replacement. It would also allow changing the resistor values even after the connector is mounted to a printed circuit board.

Also, it should be noted that the preferred embodiment is illustrated as a right angle male type connector. The techniques disclosed herein could be applied to other connector configurations, such as pin receptacles. They might also be applied to connectors in other assembly methods. In particular, the use of resistors embedded in the connector and the shielding arrangement could be generally applied to prior art connectors that use a plastic housing to hold wafers together.

Therefore, the invention should be limited only by the spirit and scope of the appended claims.

What is claimed is:

1. A modular electrical connector comprising:

a) a metal stiffener; and b) a plurality of signal contact modules attached to the metal stiffener without use of an intermediate insulative housing to hold the modules, each signal contact module comprising:

i) an insulative housing having a first and a second insulative shroud portions integrally formed therewith, ii) a plurality of contact elements extending through the insulative housing, each contact element having a tail portion extending from the insulative housing and a contact portion extending from the insulative housing between the first and second shroud portions.

2. The modular electrical connector of claim 1 wherein the contact portion of each of the plurality of contact elements comprises a pin.

3. The modular electrical connector of claim 1 wherein the stiffener comprises a plurality of holes, and each signal contact module comprises a hub inserted into one of the holes.

4. The modular electrical connector of claim 1 wherein the insulative housing is molded around the contact elements.

5. The modular electrical connector of claim 1 wherein each signal contact module contains at least one wafer, each wafer comprising:

a) an insulative housing; and b) only a single column of contact elements within the insulative housing.

6. The modular electrical connector of claim 5 wherein each signal contact module consists essentially of two wafers.

7. The modular electrical connector of claim 1 wherein the contact elements are arranged in columns and adjacent columns are spaced apart by 1.5 mm or less.

8. The modular electrical connector of claim 7 additionally comprising shield members between adjacent columns.

9. A modular electrical connector comprising:

a) a metal stiffener; and b) a plurality of modules attached to the metal stiffener, each module comprising:

i) an insulative housing having a first and a second insulative shroud portions, ii) a plurality of contact elements within the insulative housing, each contact element having a tail portion extending from the insulative housing and a contact portion extending from the insulative housing between the first and second shroud portions, wherein each module comprises wafers of a first type and wafers of a second type, each with snap fit features enabling wafers of the first type to be attached to wafers of the second type.

10. The modular electrical connector of claim 9 additionally comprising a plurality of shield members, each shield member disposed between adjacent wafers.

11. A modular electrical connector of the type having a plurality of columns of contact elements comprising:

a) a plurality of wafers positioned side to side, each wafer having an insulative housing;

b) a plurality of columns of contact elements, each column passing through one wafer and each contact element having a contact portion and a tail portion extending from the insulative housing; and c) a plurality of shield members, each shield member electrically connected at at least two points to a selected contact element, the selected contact element having an electrical disconnect between the two points.

12. The modular electrical connector of claim 11 wherein the insulative housing of each wafer has a window therein exposing at least a portion of the contact elements passing therethrough and the electrical disconnect in the selected contact element occurs in the window.

13. The modular connector element of claim 11 wherein each column of contact element comprises a plurality of rows of contact elements and the selected contact element in adjacent columns of contact elements fall in different rows.

14. The modular electrical connector of claim 11 wherein the two points on each selected contact element comprise the point at which the contact portion extends from the housing and the point at which the tail portion extends from the housing.

15. The modular electrical connector of claim 11 wherein each shield extends along the length of the column.

16. The modular electrical connector of claim 11 wherein each wafer contains only a single column contact elements and the insulative housing of the wafer is molded around the column.

17. A modular electrical connector of the type having a plurality of columns of contact elements comprising:

a) a plurality of wafers positioned side to side, each wafer having an insulative housing;

b) a plurality of columns of contact elements, each column passing through one wafer and each contact element having a contact portion and a tail portion extending from the insulative housing, selected ones of the contact elements having electrical disconnects between their contact portions and their tail portions; and c) a plurality of resistive elements, wherein the insulative housing of each wafer has at least one opening therein exposing the electrical disconnect of at least one contact element and a resistive element is positioned in the opening and attached to a selected contact element.

18. The modular electrical connector of claim 17 wherein the each resistive element has a value between 1Ω and 250Ω.

19. The modular electrical connector of claim 17 wherein the electrical disconnect comprises a cut in the contact element made through the opening.

20. The modular electrical connector of claim 17 wherein each wafer contains a single column of contact elements.

21. The modular electrical connector of claim 17 coupled to a backplane assembly having a plurality of conductive traces coupled to the selected contact elements, said conductive traces being free of serial resistors.

* * * * *